US010862214B2

(12) United States Patent
Sakurai

(10) Patent No.: US 10,862,214 B2
(45) Date of Patent: Dec. 8, 2020

(54) ANTENNA

(71) Applicant: Tyco Electronics Japan G.K., Kanagawa (JP)

(72) Inventor: Yohei Sakurai, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 15/788,898

(22) Filed: Oct. 20, 2017

(65) Prior Publication Data

US 2018/0115073 A1 Apr. 26, 2018

(30) Foreign Application Priority Data

Oct. 21, 2016 (JP) ..... 2016-206636

(51) Int. Cl.

| | |
|---|---|
| ***H01Q 9/42*** | (2006.01) |
| ***H01Q 9/28*** | (2006.01) |
| ***H01Q 1/24*** | (2006.01) |
| ***H01Q 1/38*** | (2006.01) |
| ***H01Q 21/00*** | (2006.01) |

(52) U.S. Cl.

CPC ..... *H01Q 9/285* (2013.01); *H01Q 1/242* (2013.01); *H01Q 1/243* (2013.01); *H01Q 1/38* (2013.01); *H01Q 21/0006* (2013.01); *H01Q 9/42* (2013.01)

(58) Field of Classification Search

CPC ..... H01Q 9/285; H01Q 1/242; H01Q 1/243; H01Q 1/38; H01Q 21/0006; H01Q 9/42

See application file for complete search history.

(56) References Cited

U.S. PATENT DOCUMENTS

| | | | | |
|---|---|---|---|---|
| 7,046,196 | B1 * | 5/2006 | Langley | H01Q 1/243 343/700 MS |
| 9,711,863 | B2 | 7/2017 | De Luis et al. | |
| 2005/0200545 | A1 * | 9/2005 | Bancroft | H01Q 13/10 343/770 |

(Continued)

FOREIGN PATENT DOCUMENTS

| | | | | |
|---|---|---|---|---|
| CN | 101587986 | A | 11/2009 | |
| CN | 103296385 | A * | 9/2013 | H01Q 1/24 |

(Continued)

OTHER PUBLICATIONS

Abstract of JP2003110342, dated Apr. 11, 2003, 2 pages.

(Continued)

*Primary Examiner* — Dimary S Lopez Cruz
*Assistant Examiner* — Bamidele A Jegede
(74) *Attorney, Agent, or Firm* — Barley Snyder

(57) ABSTRACT

An antenna comprises a first pad, a second pad, a radiating element, a meandering element, and a third pad disposed in an antenna region on a circuit board. The first pad and the second pad are spaced apart and disposed at opposite ends of the antenna region. The radiating element is disposed between the first pad and the second pad and is capacitively coupled to the first pad. The meandering element is connected to the radiating element at a position adjacent the first pad. The meandering element extends in the first direction away from the first pad while meandering reciprocally in the second direction. The third pad is capacitively coupled to the second pad.

11 Claims, 4 Drawing Sheets

(56) References Cited

U.S. PATENT DOCUMENTS

2007/0115181 A1* 5/2007 Park ..... H01Q 9/42 343/700 MS
2007/0285321 A1* 12/2007 Chung ..... H01Q 7/00 343/702
2011/0102272 A1* 5/2011 Wong ..... H01Q 1/38 343/702
2011/0298666 A1* 12/2011 Kim ..... H01Q 1/243 343/700 MS
2012/0206303 A1* 8/2012 Desclos ..... H01Q 1/243 343/702
2012/0299779 A1* 11/2012 Yen ..... H01Q 9/42 343/700 MS
2013/0300626 A1* 11/2013 Lee ..... H01Q 5/378 343/850
2014/0266917 A1* 9/2014 De Luis ..... H01Q 1/38 343/700 MS
2014/0354483 A1* 12/2014 Azad ..... H01Q 5/385 343/700 MS
2014/0368405 A1 12/2014 Ek et al.
2015/0171518 A1* 6/2015 Lee ..... H01Q 9/42 343/843
2015/0180118 A1* 6/2015 Huang ..... H01Q 1/526 343/841
2015/0380812 A1* 12/2015 Black ..... H01Q 9/42 343/861
2015/0380818 A1* 12/2015 Svendsen ..... H01Q 21/30 343/700 MS
2016/0043467 A1* 2/2016 Desclos ..... H01Q 5/328 343/745
2016/0352000 A1 12/2016 Ohno et al.

FOREIGN PATENT DOCUMENTS

| | | | |
|---|---|---|---|
| CN | 105144477 | A | 12/2015 |
| CN | 204966672 | U | 1/2016 |
| JP | 2003110342 | A | 4/2003 |
| WO | 2014029156 | A1 | 2/2014 |
| WO | 2015133114 | A1 | 9/2015 |

OTHER PUBLICATIONS

Cheng-Jung Lee, et al., "Small Antennas Based on CRLH Structures: Concept, Design and Applications", IEEE Antennas and Propagation Magazine, vol. 53, No. 2, Apr. 2011, 16 pages.
European Search Report, dated Feb. 23, 2018, 6 pages.
English translation of CN103296385, translation dated Feb. 15, 2018, 5 pages.
National Intellectual Property Administration, P.R. China, First Office Action, and English translation, dated Mar. 23, 2020, 16 pages.
Abstract of CN 101587986, dated Nov. 25, 2009, 1 page.
Abstract of CN 204966672, dated Jan. 13, 2016, 1 page.

* cited by examiner

ANTENNA

CROSS-REFERENCE TO RELATED APPLICATION

This application claims the benefit of the filing date under 35 U.S.C. § 119(a)-(d) of Japanese Patent Application No. 2016-206636, filed on Oct. 21, 2016.

FIELD OF THE INVENTION

The present invention relates to an antenna and, more particularly, to an antenna comprised of printed wiring on a circuit board.

BACKGROUND

Omnidirectional antennas comprised of printed wiring on a circuit board are known in the art. Japanese Patent No. 2003-110342, for example, discloses a monopole antenna having a radiating element and a ground element formed on a circuit board. In JP 2003-110342, the antenna is omnidirectional in a horizontal plane, however, since the extending directions of the radiating element and the ground element are different from each other, the antenna does not have a compact size. Further, known omnidirectional antennas such as the antenna disclosed in JP 2003-110342 are difficult to adapt to increasingly demanded broadband applications such as Long Term Evolution (LTE).

SUMMARY

An antenna according to the invention comprises a first pad, a second pad, a radiating element, a meandering element, and a third pad disposed in an antenna region on a circuit board. The first pad and the second pad are spaced apart and disposed at opposite ends of the antenna region. The radiating element is disposed between the first pad and the second pad and is capacitively coupled to the first pad. The meandering element is connected to the radiating element at a position adjacent the first pad. The meandering element extends in the first direction away from the first pad while meandering reciprocally in the second direction. The third pad is capacitively coupled to the second pad.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
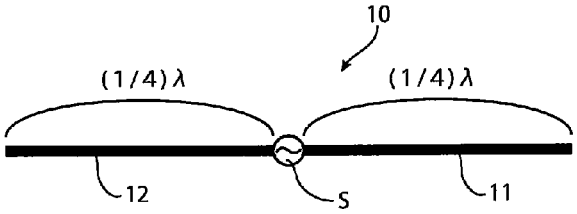
FIG. 1 is a side view of a dipole antenna.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
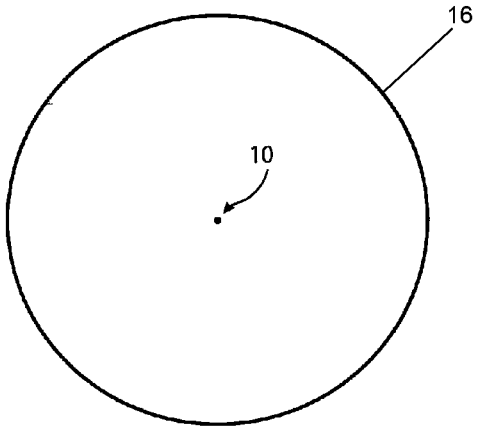
FIG. 2A is a top view of the dipole antenna of FIG. 1 with radio waves of the dipole antenna.
FIG. 2B is a side view of the dipole antenna of FIG. 1 with radio waves of the dipole antenna.
Figure 2:
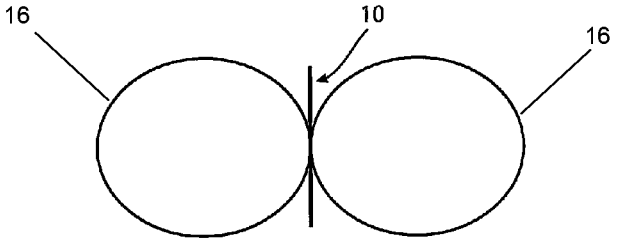
Figure 3:
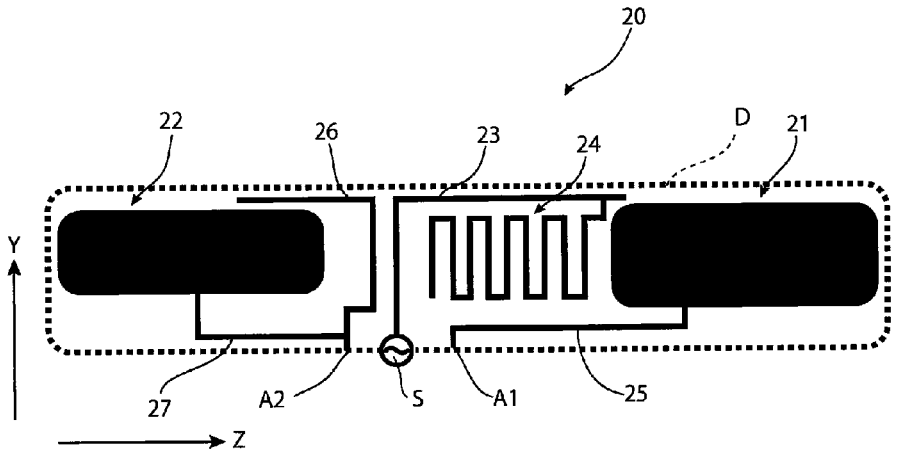
FIG. 3 is a top view of an antenna according to the invention.

An antenna 20 according to the invention is shown in FIG. 3. The antenna 20 is a type of dipole antenna 10 shown in FIGS. 1 and 2. The principle of a dipole antenna 10 will be first described, followed by a detailed description of the antenna 20 of the present invention.

The dipole antenna 10 as shown in FIG. 1 is an antenna having two linear conducting wires, a radiating element 11 and a ground element 12, attached symmetrically on both sides of a feeding point S. Each of these two elements 11, 12 has a length of ¼ of a wavelength λ of a radio wave to be radiated. A combination of both the elements 11, 12 has a length of the half wavelength, namely, (½)·λ. The dipole antenna 10 is referred to as a "half-wavelength dipole antenna." The dipole antenna 10 is omnidirectional in a horizontal plane of the dipole antenna 10 shown in FIG. 2A; radio waves 16 are radiated substantially uniformly in all directions in the horizontal plane. As shown in FIG. 2B, the dipole antenna 10 has an "eight-shaped" radio wave 16 directionality in the vertical direction.

The antenna 20 according to the invention is shown in FIG. 3. A horizontal direction in FIG. 3 is referred to as a Z direction and a vertical direction as a Y direction. The antenna 20 is disposed in a substantially rectangular antenna region D on a circuit board that is longer in the Z direction than in the Y direction. In the case of a circuit board having only the antenna 20 installed thereon, the antenna region D comprises the entire area of the circuit board. The elements 21-27 of the antenna 20 described below are disposed on the same face of the circuit board in the shown embodiment.

The antenna 20 has a first pad 21 for a low band and a second pad 22 for a low band. The first pad 21 and second pad 22 are disposed near each of short sides at both ends in the Z direction of the antenna region D with a space therebetween at a central portion in the Z direction.

The antenna 20 has a radiating element 23 disposed between the first pad 21 and the second pad 22 along the Z direction. The radiating element 23 extends from a feeding point S in the vicinity of a first long side of the antenna region D toward an opposite second long side in the Y direction. The radiating element 23 bends toward the first pad 21 and extends in the Z direction to the vicinity of the first pad 21. The radiating element 23 is capacitively coupled to the first pad 21 at its leading end portion extending in the Z direction.

The antenna 20 has a meandering element 24 connected to the radiating element 23 in the vicinity of the first pad 21. The meandering element 24 extends in the Z direction away from the first pad 21 to the vicinity of a portion of the radiating element 23 extending in the Y direction. The meandering element 24 meanders reciprocally in the Y direction along its length.

The antenna 20 has a first connection line 25 extending to the first pad 21 in the Z direction from a first adjacent point A1 adjacent to the feeding point S. The first connection line 25 is directly connected to the first pad 21. The first adjacent point A1 is on a same side of the feeding point S as the first pad 21.

The antenna 20 has a third pad 26 for a high band. The third pad 26 extends in the Y direction from a second adjacent point A2 adjacent to the feeding point S. The second adjacent point A2 is on a same side of the feeding point S as the second pad 22. The third pad 26 bends toward the second pad 22, extends in the Z direction, and is capacitively coupled to the second pad 22.

The antenna 20 has a second connection line 27 connected to the third pad 26 in the vicinity of the second adjacent point A2. The second connection line 27 extends to and is directly connected to the second pad 22.

In the antenna 20, the radiating element 23 and the first pad 21 are capacitively coupled and the third pad 26 and the second pad 22 are capacitively coupled. The characteristics of the antenna 20 are also adjusted by capacitive coupling between the first pad 21 and the meandering element 24, between the meandering element 24 and the portion extending in the Y direction of the radiating element 23, and between the radiating element 23 and the third pad 26. When the antenna 20 is placed in a standing position such that the Z direction corresponds to the vertical direction, as in the dipole antenna 10 described with reference to FIGS. 1 and 2, the antenna 20 is omnidirectional in a horizontal plane and acts as a broadband antenna.

Figure 4:
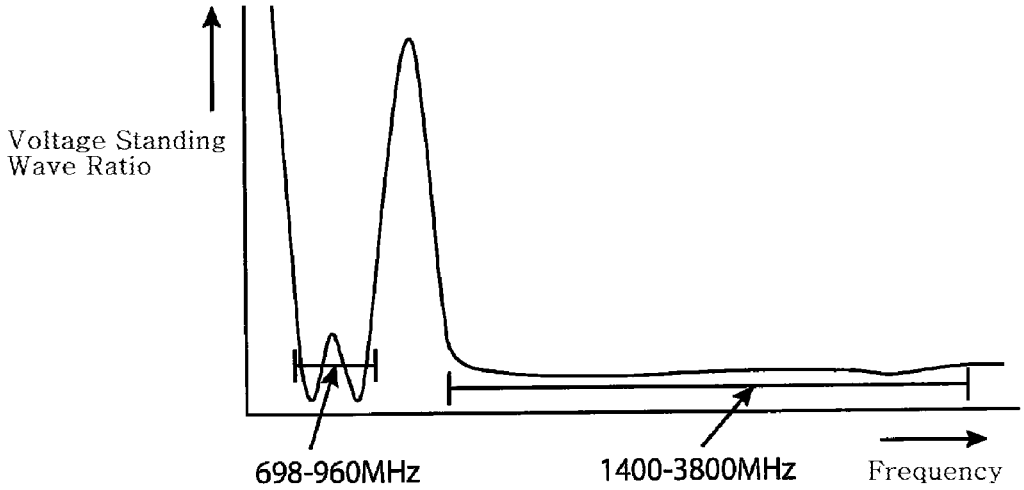
FIG. 4 is a graph of a frequency response characteristic of the antenna of FIG. 3.

FIG. 4 is a graph illustrating the frequency response characteristic of the antenna 20. The horizontal axis indicates the frequency and the vertical axis indicates the voltage standing wave ratio (VSWR). The antenna 20 has broadband characteristics of a 698-960 MHz band and a 1400-3800 MHz band.

What is claimed is:

1. A non-dipole antenna, comprising:

a first pad and a second pad disposed in a substantially rectangular antenna region on a circuit board, the substantially rectangular antenna region having a pair of long sides extending in a first direction and a pair of short sides extending in a second direction perpendicular to the first direction, the first pad and the second pad respectively disposed near one or the other of the pair of short sides at opposite ends of the antenna region in the first direction and spaced apart from each other;

a radiating element disposed in the antenna region between the first pad and the second pad where the first pad and the second pad are spaced apart from each other in the first direction, the radiating element extending in the second direction from a feeding point located about a first long side of the pair of long sides toward an opposite second long side of the pair of long sides and bending to extend in the first direction toward the first pad, the radiating element being capacitively coupled to the first pad;

a meandering element disposed in the antenna region and connected to the radiating element at a position adjacent the first pad, the meandering element extending along the first direction away from the first pad while meandering reciprocally in the second direction; and a third pad extending from the first long side toward the second long side in the second direction and bending to extend along the first direction toward the second pad, the third pad capacitively coupled to the second pad, wherein the first pad, the second pad, the radiating element, the meandering element, and the third pad are disposed on a single horizontal plane on a same face of the circuit board; and wherein the antenna is omnidirectional in the horizontal plane.

2. The antenna of claim 1, further comprising a first connection line disposed in the antenna region and extending from the first long side to the first pad.

3. The antenna of claim 2, wherein the first connection line is directly connected to the first pad.

4. The antenna of claim 2, wherein the first connection line extends from a first adjacent point on the first long side adjacent the feeding point.

5. The antenna of claim 4, wherein the third pad extends from a second adjacent point on the first long side adjacent the feeding point.

6. The antenna of claim 5, wherein the first adjacent point and the second adjacent point are disposed on opposite sides of the feeding point in the first direction.

7. The antenna of claim 6, wherein the first adjacent point is disposed on a same side of the feeding point as the first pad and the second adjacent point is disposed on a same side of the feeding point as the second pad.

8. The antenna of claim 2, further comprising a second connection line extending from the third pad to the second pad and directly connected to the second pad.

9. The antenna of claim 1, wherein the first pad and the second pad are for a low band of the antenna and the third pad is for a high band of the antenna.

10. The antenna of claim 9, wherein the low band is within about 698-960 MHz band.

11. The antenna of claim 10, wherein the high band is within about 1400-3800 MHz band.

* * * * *